US005266011A

United States Patent [19]

Son

[11] Patent Number: 5,266,011

[45] Date of Patent: Nov. 30, 1993

[54] OIL DISTRIBUTION GEAR PUMPS WITH INTEGRATED AIR SEPARATORS

[75] Inventor: Daewon Son, Seoul, Rep. of Korea

[73] Assignee: Dong Hwa Instrument Co., Ltd., Kyungki, Rep. of Korea

[21] Appl. No.: 4,085

[22] Filed: Jan. 13, 1993

[51] Int. Cl.[5] ..... F04B 49/00

[52] U.S. Cl. ..... 47/297.5; 417/308

[58] Field of Search ..... 417/298.5, 307, 308, 417/310, 470; 92/129; 418/131, 135, 169, 171

[56] References Cited

U.S. PATENT DOCUMENTS 3,443,522 5/1969 Schindler ..... 418/169 X
4,773,836 9/1988 Moore ..... 418/DIG. 1
5,199,858 4/1993 Tsuboi et al. ..... 418/DIG. 1

FOREIGN PATENT DOCUMENTS 91-15775 9/1991 Rep. of Korea .

*Primary Examiner*—Richard A. Bertsch
*Assistant Examiner*—Alfred Basichas
*Attorney, Agent, or Firm*—Longacre & White

[57] ABSTRACT

An oil distribution gear pump with an integrate air pump. This pump comprises a main body being divided into an oil distribution chamber and an oil recirculation chamber, these chambers being adapted for distributing oil to the outside and recovering oil from oil bubbles, respectively, and communicating with each other through a bubble circulation conduit and an oil recovering port. The eccentric rotary gear assembly for sucking up oil and feeding the oil to the oil distribution chamber includes a drive gear internally engaging with an eccentric rotary gear. This gear assembly is elastically supported by a compression coil spring such that the drive gear elastically advances and retracts when the eccentric rotary gear eccentrically rotates. The first and second floats are arranged in the oil distribution chamber and the oil recirculation chamber for closing or opening the bubble circulation conduit and the oil recovering port, respectively. The bubble circulation conduit is connected to an air separator for separating air from oil bubbles and ejecting the oil bubbles to the inside of the oil recirculation chamber in order to burst these bubbles. The separated air is discharged to the outside, while the remaining oil is recovered by the oil distribution chamber.

3 Claims, 3 Drawing Sheets

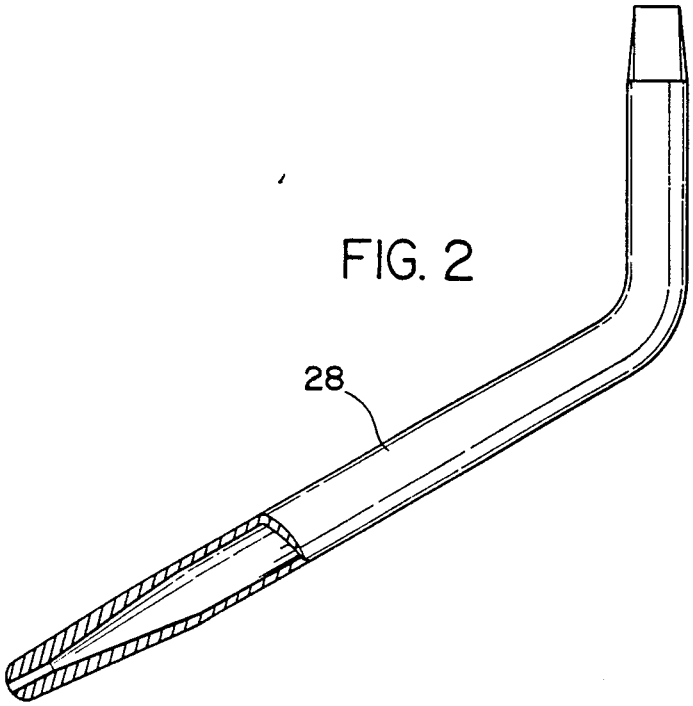
FIG. 2
FIG. 3
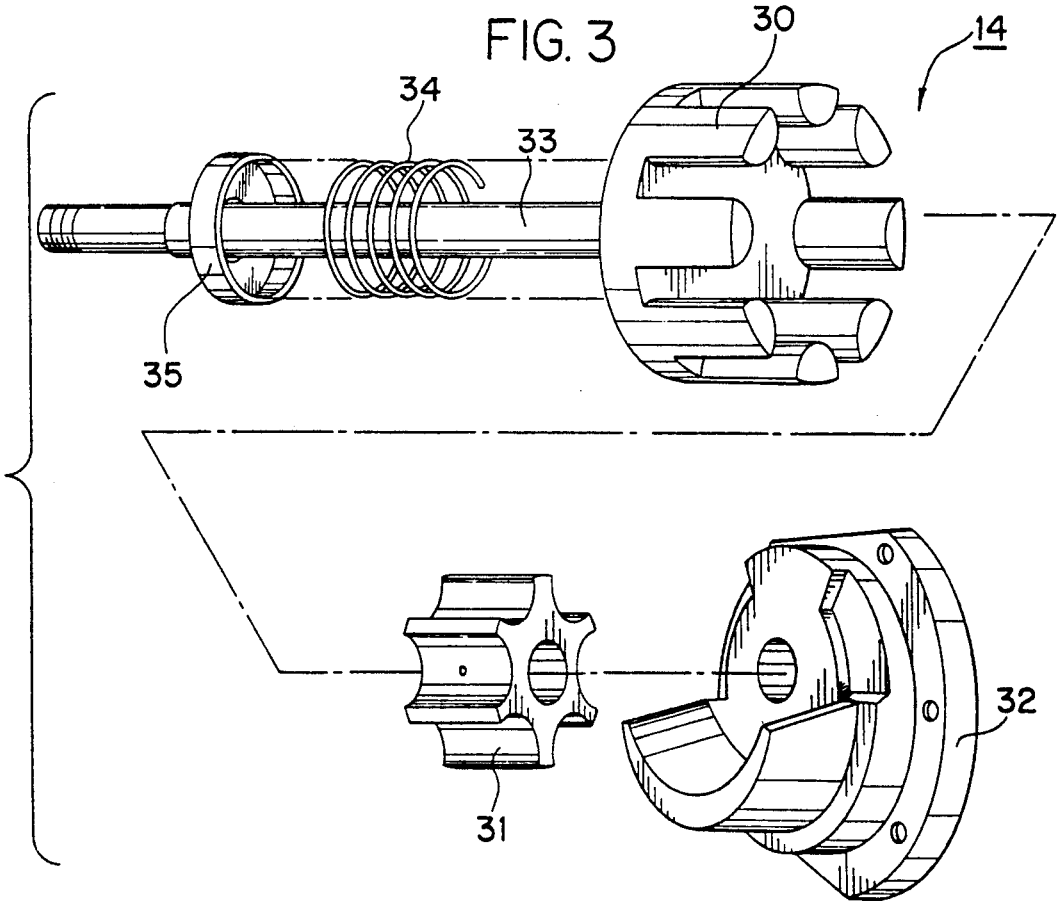

OIL DISTRIBUTION GEAR PUMPS WITH INTEGRATED AIR SEPARATORS

BACKGROUND OF THE INVENTION

1. Field of the Invention

The present invention relates in general to oil distribution gear pumps for oil distributors used in refueling stations and, more particularly, to an oil distribution gear pump with an integrated air separator for separating air from oil bubbles.

2. Description of the Prior Art

Conventionally, oil distributors used in refueling stations include oil distribution gear pumps at their lower inner parts, respectively, for sucking up oil, such as gasoline and volatile oil, out of underground oil reservoirs and distributing the oil to an object to be refueled, such as automobiles and similar vehicles. Here, as well noted to those skilled in the art, a plurality of oil bubbles have been naturally generated in sucking up and distributing the oil by the gear pumps and this obstructs normal oil distribution. In this respect, it has been required to separate air from the oil bubbles and to exhaust the separated air to the outside while recovering the remaining oil. In order to achieve this object, the known oil gear pumps have been generally provided with individual air separators.

However in many cases, the known air separator has not been installed inside the gear pump, but installed at the outside of the gear pump because of structural limit of a main body of the gear pump.

For example, the known oil distribution gear pump generally has a float provided therein and a conventional air separator provided at the outside thereof. Thanking for such a construction, the float gradually rises as the inner space of the gear pump is gradually filled with the oil. When the float rises to reach a predetermined level, this float opens a bubble exhaust port and, as a result, the oil bubbles pass through the opened bubble exhaust port and are introduced into the air separator which is provided at the outside of the gear pump and where the air is separated from the oil bubbles. After separation, the air is exhausted to the outside, i.e., the atmosphere, through an air exhaust port but the remaining oil is recovered by an oil distribution chamber of the gear pump in order to be distributed therefrom.

However, this known gear pump must occupy considerable part of the inner space of the oil distributor due to the air separator provided at the outside of the gear pump in the oil distributor. In this regard, this type of gear pump has a disadvantage in that it resists to the recent trend of compactness and lightness of the oil distributors. Furthermore, it has been noted that there is difficulty in assembling and disassembling the gear pump due to the outside air separator and, therefore, this known gear pump has an additional disadvantage in that much labor must be consumed in manufacture and maintenance thereof.

In recent, a Japanese patent has disclosed an improved known gear pump technology to somewhat solve the above disadvantages. In this known Japanese technology, the air separator is equipped inside the gear pump and, in this respect, the recent trend of compactness and lightness of oil distributor can be somewhat achieved and the assembling and disassembling of the gear pump are relatively simplified and do not require much labor as opposed to the known gear pump having the outside air separator.

However, this type of pump necessarily requires to not only divide its inner space into several chambers, but also be provided with a linear ejection pipe which is adapted to strongly eject the oil bubbles. This linear ejection pipe has a uniform inner diameter throughout its length. Hence, much labor as well as many manufacturing steps must be necessary in manufacture of this type of gear pump, thereby causing manufacturing cost to be remarkably increased.

Accordingly, it has been required to provide an improved gear pump with an integrated air separator which can be manufactured through a relatively simplified process and, as a result, reduce manufacturing cost.

In an effort to achieve this object, there has been proposed an improved gear pump having an integrated air separator such as disclosed in Korean Patent Application No. 91-15775 applied by the present applicant.

This Korean patent has disclosed a gear pump of which inner space is divided into two chambers by an integral partition. This partition also has a bubble ejection pipe which is mounted on an upper part of this partition in such a manner that this pipe penetrates the upper part of the partition and maintains its position by employing screwed type mounting. In this regard, an inlet port of the bubble ejection pipe opens to the inner space of an oil distribution chamber of the pump, while an ejection port thereof opens to an oil recirculation chamber of the pump. In addition, a float is provided in an appropriate portion of the inner space of the oil recirculation chamber separated from the oil distribution chamber. In order to allow the air separated from the oil to be exhausted to the outside of the gear pump, i.e., the atmosphere, a main body of the gear pump is provided with an air exhaust port above the float. An oil recovering conduit is provided under the float so as to return the remaining oil to the oil distribution chamber. Here, the bubble ejection pipe has varied inner diameters such that input and ejection ends of the pipe have smaller inner diameters, respectively, while the center part of the pipe has an enlarged inner diameter.

Thanking for such a construction, when the oil gradually fills the inner space of the oil distribution chamber of the gear pump, the oil bubbles floating on the surface of the oil filling the chamber rise to a predetermined level. The oil bubbles are, thereafter, introduced into the bubble ejection pipe and in turn ejected from the ejection port of the bubble ejection pipe to the oil recirculation chamber including the float. At this time, the oil bubbles are pressurized when they pass through the ejection pipe due to the varied inner diameters of the pipe and ejected from the ejection port of the pipe at a considerable pressure. These bubbles ejected from the bubble ejection pipe strongly strike against the inner wall of the oil recirculation chamber and burst so as to separate the air from the oil bubbles. The separated air is, thereafter, exhausted to the outside of the gear pump through the air exhaust port. The remaining oil gradually fills the inner space of the oil recirculation chamber until the float rises to the predetermined level at which the float opens the oil recovering conduit. When the float opens the oil recovering conduit, the remaining oil passes through the opened oil recovering conduit in order to be recovered by the oil distribution chamber and in turn distributed therefrom.

This type of known gear pump, while somewhat simplifying its manufacturing process due to the integrated air separator and, as a result, reducing manufacturing cost, nevertheless has the bubble ejection pipe which penetrates the partition and is mounted thereon by employing the screwed type mounting. In this regard, this known gear pump has a disadvantage in that it still requires burdensome screw type mounting of the bubble ejection pipe and, furthermore, causes pure oil as well as the oil bubbles to be introduced into the bubble ejection pipe due to its construction. In addition, in this known gear pump, an eccentric gear assembly is rotatably supported on the pump main body using only a rotating shaft with no additional supporting members. In this respect, the oil distribution amount of this gear pump is deficient to satisfy a desired level.

SUMMARY OF THE INVENTION

It is, therefore, an object of the present invention to provide an oil distribution gear pump with an integrated air separator in which the above disadvantages can be overcome and which is simply manufactured, prevents pure oil other than the oil bubbles from being introduced into the bubble ejection pipe and improves oil distribution amount of the pump.

In accordance with a preferred embodiment of the present invention, the above object can be accomplished by providing an oil distribution gear pump for an oil distributor comprising: a main body being divided into an oil distribution chamber and an oil recirculation chamber, said chambers being adapted for distributing oil to the outside and recovering oil from oil bubbles, respectively, and communicating with each other through a bubble circulation conduit and an oil recovering port; an eccentric rotary gear assembly for sucking up oil and feeding the oil to the oil distribution chamber, said gear assembly including a drive gear internally engaging with an eccentric rotary gear and said gear assembly being elastically supported by a compression coil spring such that the drive gear elastically advances and retracts when the eccentric rotary gear eccentrically rotates; first and second floats being adapted for closing or opening the bubble circulation conduit and the oil recovering port, respectively; and an air separator for separating air from oil bubbles, said air separator being connected to the bubble circulation conduit of the main body and ejecting the oil bubbles to the inside of the oil recirculation chamber.

BRIEF DESCRIPTION OF THE DRAWINGS

The above and other objects, features and other advantages of the present invention will be more clearly understood from the following detailed description taken in conjunction with the accompanying drawings, in which:

FIG. 2 is a partially broken side view of a bubble ejection pipe of the gear pump of FIG. 1;

FIG. 3 is an exploded perspective view of an eccentric rotary gear assembly of the gear pump of FIG. 1;

DETAILED DESCRIPTION OF THE PREFERRED EMBODIMENT

Figure 1:
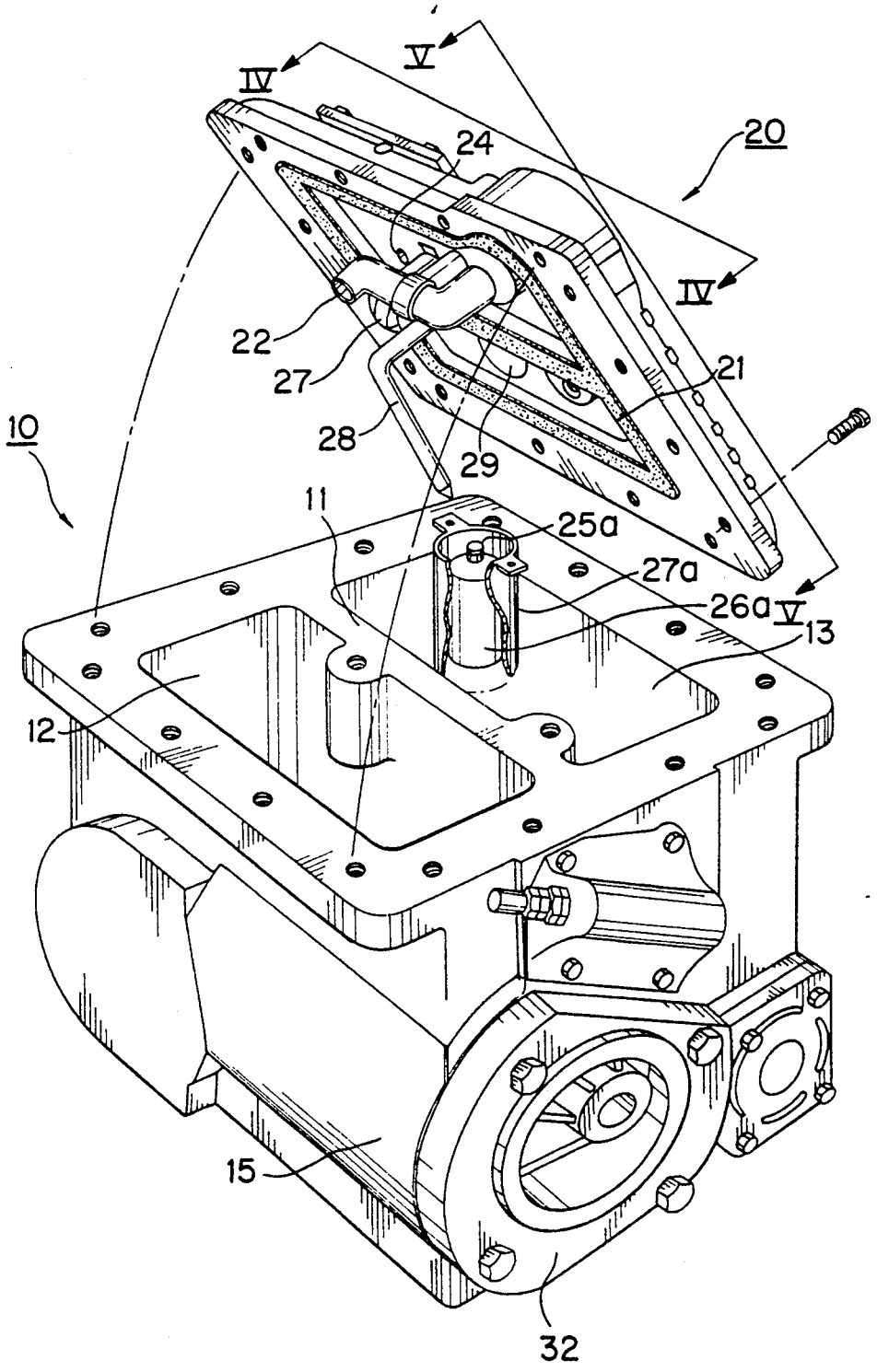
FIG. 1 is an exploded perspective view showing a construction of a gear pump in accordance with an embodiment of the present invention.
Figure 5:
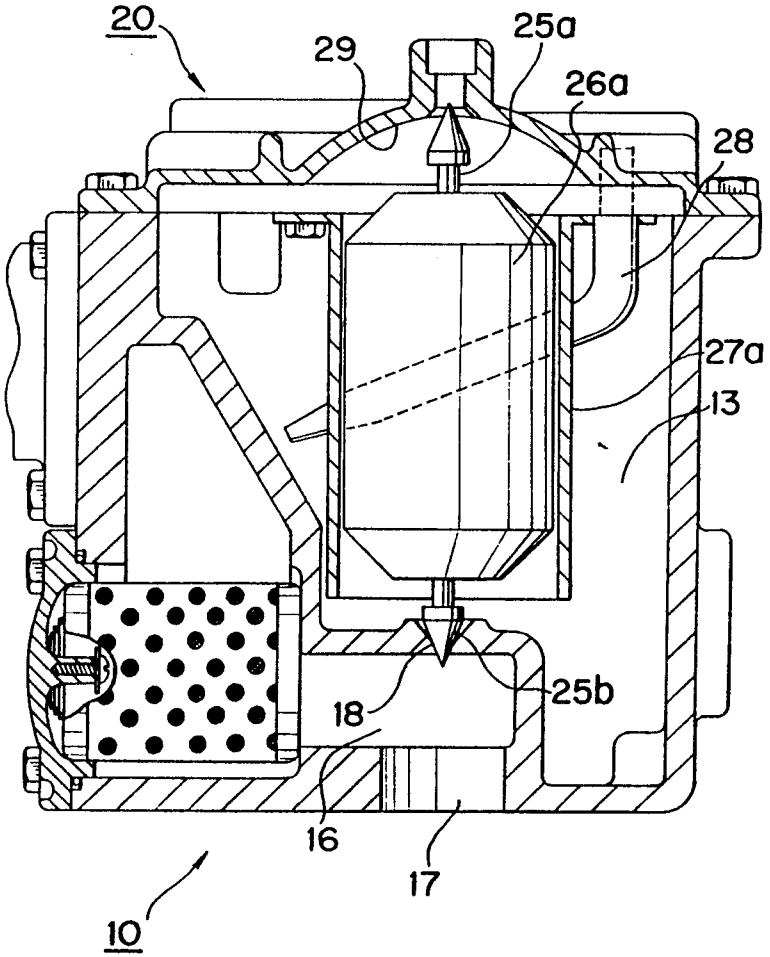
FIGS. 4 and 5 are sectional views of the gear pump of FIG. 1 sectioned along IV—IV and V—V section lines, respectively, in order to show in detail the construction of the gear pump.
Figure 4:
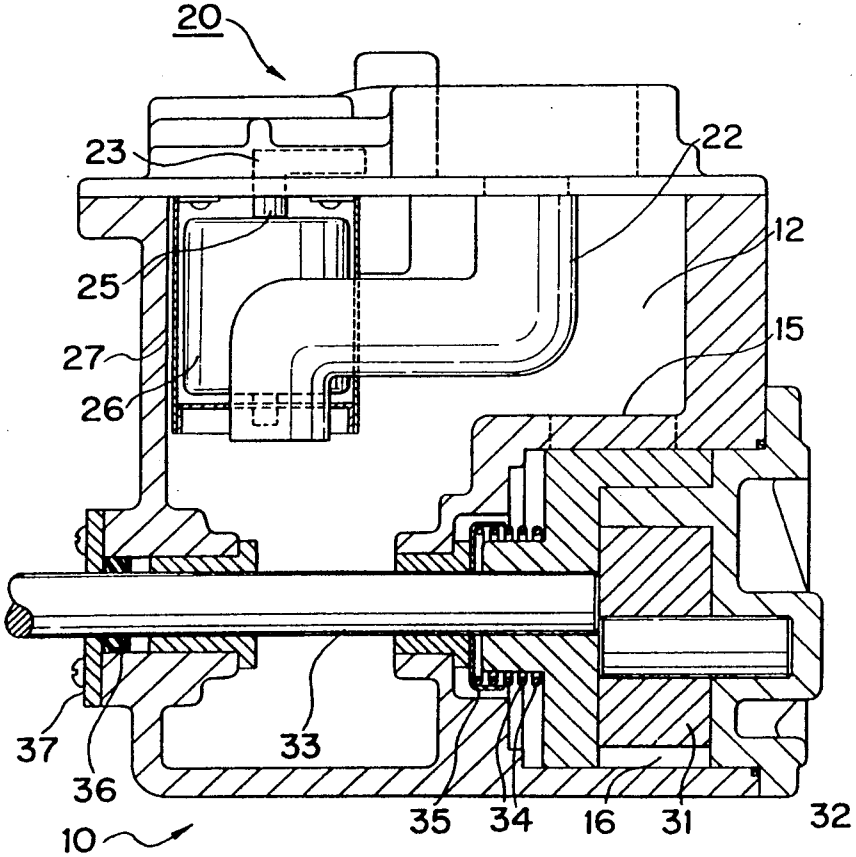

With reference to FIG. 1 showing a construction of a gear pump of this invention, a main body 10 of the gear pump is divided into two chambers, i.e., an oil distribution chamber 12 and an oil recirculation chamber 13, by an integral partition 11. The oil distribution chamber 12 is provided at its lower part with a gear box 15 which receive an eccentric rotary gear assembly 14 which will be described again. In this gear box 15, an oil inlet part 16 is provided and communicates with a bottom of the oil recirculation chamber 13 through an oil recovering port 18. Thanking for provision of this oil inlet part 16 and the oil recovering port 18, the oil recirculation chamber 13 communicates with an oil inlet port 17 which is provided at a lower part of the pump main body 10.

In addition, the oil recirculation chamber 13 is provided at its bottom with the oil recovering port 18 which in turn communicates with the oil inlet part 16 of the gear box 15. In this regard, the remaining oil resulting from the air and oil separation of the oil bubbles can be returned to the oil distribution chamber 12.

The gear pump main body 10 is covered with a lid 20 which is provided with an airtight packing 21 for sealing the connection part between the main body 10 and the lid 20. This lid 20 has an oil discharging pipe 22, a bubble circulation conduit 23 and an air exhaust port 24. Under the lid 20, a first cylindrical casing 27 is mounted on a lower surface of the lid 20 such that its inner space communicates with the bubble circulation conduit 23. This first cylindrical casing 27 movably receives a first float 26 which has an upper protrusion 25 which is aligned with the bubble circulation conduit 23 for opening or closing this conduit 23 in response to a position of the first float 26. The bubble circulation conduit 23 communicates with the bubble ejection pipe 28 and this allows the oil bubbles to be transmitted from the inner space of the first cylindrical casing 27 to the bubble ejection pipe 28. At a side of bubble ejection pipe 28, a dome-shaped air guide member 29 having a center through hole is arranged for guiding air separated from the oil bubbles to the outside of the gear pump. In addition, a second cylindrical casing **27*a* opening to its lower part is mounted below the air guide member 29. This second cylindrical casing 27*a* receives a second float 26*a* such that this float 26*a* can slide upwards and downwards as guided by the second casing 27*a*. The second float 26*a* has upper and lower protrusions 25*a* and 25*b* at its upper and lower ends, respectively. Here, the upper protrusion 25*a* is adapted to open or close the center through hole of the air guide member 29 in response to a position of the float 26*a* and to control the exhaust air, while the lower protrusion 25*b* is adapted to open or close the oil recovering port 18** and to control the oil recovery.

FIG. 2 shows the bubble ejection pipe 28 in detail. As shown in this drawing, this bubble ejection pipe 28 has varied inner diameters such that ejection and inlet ends of the pipe 28 have smaller inner diameters, respectively, while the center part of the pipe 28 has an enlarged inner diameter.

Turning to FIG. 3 showing the eccentric rotary gear assembly 14 received in the gear box 15 of the gear pump, the gear assembly 14 includes a drive gear 30 internally engaging with an eccentric rotary gear 31. The internal engagement of the gears 30 and 31 is maintained by an end plate 32. The drive gear 30 is supplied with rotational force of an outside drive motor (not shown) by means of a rotating shaft 33 connecting this drive gear 30 to the motor. In order to provide a sufficient resilience for the drive gear 30 and to bias this gear 30 toward the end plate 32, a compression coil spring 34 is mounted around the rotating shaft 33 at the rear end of the drive gear 30 and compressed by a compression cup 35 which is also mounted around the shaft 33. This compression cup 35 is in turn received in a cup-shaped receiver of a boss of the pump main body 10, the boss being adapted to rotatably support the rotating shaft 33. The main body 10 has another boss for rotatably supporting the rotating shaft 33 at the rear part of the body 10. When the shaft 33 is inserted in the another boss, a rubber packing 36 is mounted around the shaft 33 in order to seal between the boss and the shaft 33 and a mounting plate 37 is tightly mounted, using set screws, on an outer surface of the main body 10 for maintaining the rubber packing 36 and isolating the inner space of the main body 10 from the outside.

hereinbelow, the operational effect of the gear pump having the above construction will be described.

When the drive motor is applied with outside electric power, this motor drives the rotating shaft 33 and the drive gear 30. The rotation of the drive gear 30 makes the eccentric rotary gear 31, internally engaging with the drive gear 30 and rotatably supported by the end plate 32 by its rotating shaft, be eccentrically rotated inside the end plate 32. The eccentric rotation of the rotary gear 31 causes the inlet part 16 of the gear box 15 to be pressurized. As a result, the oil of the oil reservoir is introduced into the oil inlet part 16 of the gear box 15 through the oil inlet port 17 and in turn introduced into the oil distribution chamber 12 of the main body 10 by virtue of the eccentric rotation of the rotary gear 31.

When the drive gear 30 is rotated, the compression coil spring 34 causes the drive gear 30 to elastically advance and this improves suction power for introducing the oil from the oil reservoir to the oil distribution chamber 12. Here, a plurality of oil bubbles are naturally generated in the chamber 12 and float on the surface of the oil. These bubbles are introduced into the bubble ejection pipe 28 through the bubble circulation conduit 23 until the oil fills the inner space of the oil distribution chamber 12 to a predetermined level. At this time, the air inside the oil distribution chamber 12 is discharged to the outside through the air discharging port 24. When the oil fills the inner space of the chamber 12 to the predetermined level, the first float 26 rises as guided by the first cylindrical casing 27 and causes its upper protrusion 25 to block the bubble circulation conduit 23. At this time, the oil is discharged to the outside through the oil discharging pipe 22. Here, since the bubble circulation conduit 23 is blocked by the upper protrusion 25 of the first float 26, the oil can not be introduced into the bubble ejection pipe 28 through the bubble circulation conduit 23 as opposed to the known gear pump disclosed in the Korean Patent Application No. 91-15775.

The oil bubbles introduced into the bubble ejection pipe 28 are remarkably increased in their pressure and flow velocity when they pass through the input port of the pipe 28 which has the smaller inner diameter and, as a result, exhibit liquid phase. This liquid phase bubbles pass, thereafter, through the center part of the pipe 28 which has the enlarged inner diameter. As a result, the bubbles are reduced in their pressure and flow velocity and change their phase into gas phase. When these gas bubbles are ejected from the ejection port of the pipe 28 which has the smaller inner diameter, their phase is changed into the liquid phase due to the reduced inner diameter of the ejection port of the pipe 28. Here, the oil bubbles are ejected at a considerable high speed and at a high pressure and strongly strike against the inner wall of the oil recirculation chamber 13 to burst. This burst of the bubbles results in separation of air from liquid oil. The air is discharged to the outside as guided by the dome-shaped guide member 29 of the pump lid 20, while the liquid oils fills the inner space of the oil recirculation chamber 13 to a predetermined level. Until the liquid oil reaches the predetermined level, the lower protrusion **25*b* of the second float 26*a* blocks the oil recovering conduit 18 and, as a result, the oil in the chamber 13 can not be recovered by the oil distribution chamber 12. However, when the oil reaches the predetermined level of the chamber 13, the second float 26*a* rises and causes its lower protrusion 25*b* to open the oil recovering port 18. The oil in the oil recirculation chamber 13 is thus introduced into the oil input part 16 of the gear box 15 and in turn recovered by the oil distribution chamber 12**.

As described above, the present invention provides a gear pump with an integrated air separator for an oil distributor which is divided into oil distribution and oil recirculation chambers communicating with each other through conduits. The chambers are provided with individual floats for opening or closing the conduits. The integrated air separator receives oil bubbles generated in the oil distribution chamber and ejects the bubbles to the oil recirculation chamber in order to separate air from the oil. The separated air is discharged to the outside, while the remaining oil is recovered by the oil distribution chamber. The gear pump has an advantage in that it is simply manufactured, prevents pure oil from being introduced into the bubble ejection pipe and improves oil distribution amount of the pump.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An oil distribution gear pump comprising:

a main body being divided into an oil distribution chamber and an oil recirculation chamber, said chambers being adapted for distributing oil to the outside and recovering oil from oil bubbles, respectively, and communicating with each other through a bubble circulation conduit and an oil recovering port;

an eccentric rotary gear assembly for sucking up oil and feeding said oil to said oil distribution chamber, said gear assembly including a drive gear internally engaging with an eccentric rotary gear and said gear assembly being elastically supported by biasing means such that said drive gear elastically advances and retracts when said eccentric rotary gear eccentrically rotates;

first and second floats being adapted for closing or opening said bubble circulation conduit and said oil recovering port, respectively; and an air separator for separating air from oil bubbles, said air separator being connected to said bubble circulation conduit of the main body and ejecting said oil bubbles to the inside of said oil recirculation chamber.

2. An oil distribution gear pump according to claim 1, wherein said main body further includes an air exhaust port for exhausting air from said oil distribution chamber and a dome-shaped guide member for guiding air separated from said oil bubbles to the outside of the gear pump.

3. An oil distribution gear pump according to claim 1, further comprising an air exhaust pipe have such varied inner diameters that input and ejection ends of said pipe have reduced inner diameters, respectively, while a center part of said pipe has an enlarged inner diameter.

* * * * *